US009930978B2

(12) United States Patent
Habib

(10) Patent No.: US 9,930,978 B2
(45) Date of Patent: Apr. 3, 2018

(54) VACUUM PACKAGING

(71) Applicant: Timeless Food Technologies Ltd., Ramat Gan (IL)

(72) Inventor: Michel Habib, Ramat Gan (IL)

(73) Assignee: Timeless Food Technologies Ltd., Ramat Gan (IL)

( * ) Notice: Subject to any disclaimer, the term of this patent is extended or adjusted under 35 U.S.C. 154(b) by 173 days.

(21) Appl. No.: 14/813,164

(22) Filed: Jul. 30, 2015

(65) Prior Publication Data

US 2015/0327699 A1 Nov. 19, 2015

Related U.S. Application Data

(63) Continuation-in-part of application No. 13/897,409, filed on May 19, 2013.
(Continued)

(51) Int. Cl.
*B65D 1/36* (2006.01)
*B65D 1/42* (2006.01)
(Continued)

(52) U.S. Cl.
CPC ..... *A47G 19/02* (2013.01); *B65B 61/22* (2013.01); *B65D 51/26* (2013.01);
(Continued)

(58) Field of Classification Search
CPC ... B65D 1/24; B65D 1/36; B65D 1/42; B65D 81/2015; B65D 85/36; B65D 2585/366;
(Continued)

(56) References Cited

U.S. PATENT DOCUMENTS 3,655,110 A 4/1972 Eisenbach
D254,599 S * 4/1980 Otto ..... D7/541
(Continued)

FOREIGN PATENT DOCUMENTS

EP 0748746 A1 12/1996
EP 1866214 B1 6/2010
(Continued)

OTHER PUBLICATIONS

Supplementary European Search Report for corresponding EP application 13793578 dated Nov. 13, 2015.

*Primary Examiner* — J. Gregory Pickett
*Assistant Examiner* — Niki M Eloshway
(74) *Attorney, Agent, or Firm* — Eitan, Mehulal & Sadot

(57) ABSTRACT

A vacuum sealable container for baked or cooked food including a base section to receive the food in its entirety, the base section having at least one runner where the at least one runner divides the base section into equally sized portions and a lid shaped to fit the base section, the lid having at least one blade where the at least one blade slots into the at least one runner when the lid is placed over the base to close the container and where the at least one blade performs at least one of: cutting the food into the equally sized portions and holding the food in place between the at least one blade and the at least one runner and where the container is at least one of: sealed with a vacuum when used with a vacuum sealing bag and a vacuum machine and self-sealing.

8 Claims, 17 Drawing Sheets

Related U.S. Application Data

(60) Provisional application No. 61/651,067, filed on May 24, 2012.

(51) Int. Cl.

| | |
|---|---|
| ***A47G 19/02*** | (2006.01) |
| ***B65D 51/26*** | (2006.01) |
| ***B65D 81/20*** | (2006.01) |
| ***B65D 85/36*** | (2006.01) |
| ***B65B 61/22*** | (2006.01) |
| *B65D 1/44* | (2006.01) |
| *B65B 31/04* | (2006.01) |

(52) U.S. Cl.
CPC ..... *B65D 81/2015* (2013.01); *B65D 85/36* (2013.01); *B65B 31/048* (2013.01); *B65D 2585/366* (2013.01)

(58) Field of Classification Search
CPC ..... B65D 51/26; A47G 19/02; B65B 31/048; B65B 61/22
USPC ..... 220/555, 507, 653, 4.21, 780, 782, 565, 220/231, 366.1, 556
See application file for complete search history.

(56) References Cited

U.S. PATENT DOCUMENTS

| | | | | |
|---|---|---|---|---|
| 4,545,487 | A * | 10/1985 | Asmus | B65D 81/383 206/508 |
| 4,685,274 | A | 8/1987 | Garwood | |
| 5,984,130 | A | 11/1999 | Hayes et al. | |
| 6,042,856 | A | 3/2000 | Sagan et al. | |
| 6,595,366 | B1 * | 7/2003 | Brown | B65D 43/0222 206/525 |
| 7,398,882 | B2 | 7/2008 | Barrett et al. | |
| D592,076 | S | 5/2009 | Sipe et al. | |
| D592,077 | S | 5/2009 | Sipe et al. | |
| 8,083,084 | B2 | 12/2011 | Vovan | |
| D661,601 | S | 6/2012 | Sanfilippo | |
| 2003/0108643 | A1 | 6/2003 | Hornsby et al. | |
| 2004/0134920 | A1 | 7/2004 | Baron | |
| 2005/0061813 | A1 * | 3/2005 | Vilalta | B65B 31/047 220/212 |
| 2005/0082305 | A1 * | 4/2005 | Dais | B65D 43/021 220/785 |
| 2005/0145638 | A1 * | 7/2005 | Van Handel | B32B 27/08 220/782 |
| 2005/0242092 | A1 * | 11/2005 | Sinton | B65D 1/36 220/4.21 |
| 2008/0277400 | A1 * | 11/2008 | Welsh | B65D 77/225 220/592.2 |
| 2009/0100802 | A1 | 4/2009 | Bush | |
| 2009/0142454 | A1 | 6/2009 | Clark et al. | |
| 2009/0200194 | A1 * | 8/2009 | Kovacevich | B65D 1/36 206/561 |
| 2010/0181318 | A1 | 7/2010 | Bava et al. | |
| 2011/0180446 | A1 | 7/2011 | Kidd et al. | |
| 2013/0004625 | A1 | 1/2013 | Brummer et al. | |

FOREIGN PATENT DOCUMENTS

| | | |
|---|---|---|
| GB | 593653 | 10/1947 |
| WO | 2003076302 | 9/2003 |

* cited by examiner

VACUUM PACKAGING

CROSS-REFERENCE TO RELATED APPLICATIONS

This application is a continuation-in-part application claiming benefit from U.S. patent application Ser. No. 13/897,409, filed May 19, 2013, which is hereby incorporated in its entirety by reference. This application also claims benefit from U.S. Provisional Patent Application No. 61/651,067, filed 24 May 2012, which is hereby incorporated in its entirety by reference.

FIELD OF THE INVENTION

The present invention relates to the packaging of food products generally and in particular, to vacuum packaging of food products.

BACKGROUND OF THE INVENTION

Vacuum packaging is known in the art and provides a convenient solution for extending the shelf life of foods and/or reducing the volume of the package. Vacuum packaging involves removal of air from the package prior to sealing. It reduces the amount of atmospheric oxygen in the packaging and thus inhibits the growth of aerobic bacteria or fungi. It is used for storage of dry foods, such as cereals or coffee, over a long period of time and for storage of fresh foods, such as vegetables, or fish, or meat, over a shorter period of time. Vacuum packaging comes in various shapes and can be rigid or flexible.

SUMMARY OF THE PRESENT INVENTION

There is provided in accordance with a preferred embodiment of the present invention, a vacuum sealable container for baked or cooked food. The container includes a base section to receive the food in its entirety, the base section having at least one runner where the at least one runner divides the base section into equally sized portions and a lid shaped to fit over the base section, the lid having at least one blade where the at least one blade slots into the at least one runner when the lid is placed over the base to close the container and where the at least one blade performs at least one of: cutting the food into the equally sized portions and holding the food in place between the at least one blade and the at least one runner and where the container is at least one of: sealed with a vacuum when used with a vacuum sealing bag and a vacuum machine and self-sealing.

Moreover, in accordance with a preferred embodiment of the present invention, the container also includes least one air hole when the container is closed where the vacuum machine withdraws air via the least one air hole to form the vacuum.

Further, in accordance with a preferred embodiment of the present invention, the container includes at least two reinforcement ribs placed perpendicularly to the at least one runner and the at least one blade.

Still further, in accordance with a preferred embodiment of the present invention, at least one of: the at least one blade, the at least one runner and the at least two reinforcement ribs provide reinforced support against deformation from a pressure differential of up to 2 $kg/cm^2$.

Additionally, in accordance with a preferred embodiment of the present invention, the vacuum seals the lid against the base.

Moreover, in accordance with a preferred embodiment of the present invention, the blades are at least one of: plain edge and serrated.

Further, in accordance with a preferred embodiment of the present invention, the blades are manufactured from at least one of: polypropylene, polyethylene, polystyrene and ABS.

Still further, in accordance with a preferred embodiment of the present invention, blades are at least one of: permanent and detachable.

Additionally, in accordance with a preferred embodiment of the present invention, the food is at least one of: single and flat and multiple and stacked.

There is provided in accordance with a preferred embodiment of the present invention, a self-sealable vacuum container for baked and cooked food. The container includes a single inlet connectable to a vacuum pump; means for the inlet to maintain a vacuum therein and elements to provide reinforced support against deformation of the container in the presence of the vacuum.

Moreover, in accordance with a preferred embodiment of the present invention, the elements include at least one of: reinforcement units, load bearing units, scalloped edges, blades and runners.

Further, in accordance with a preferred embodiment of the present invention, the means is at least one of: a one-way diaphragm over the surface of the inlet, an attached cap and an attachable cap.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
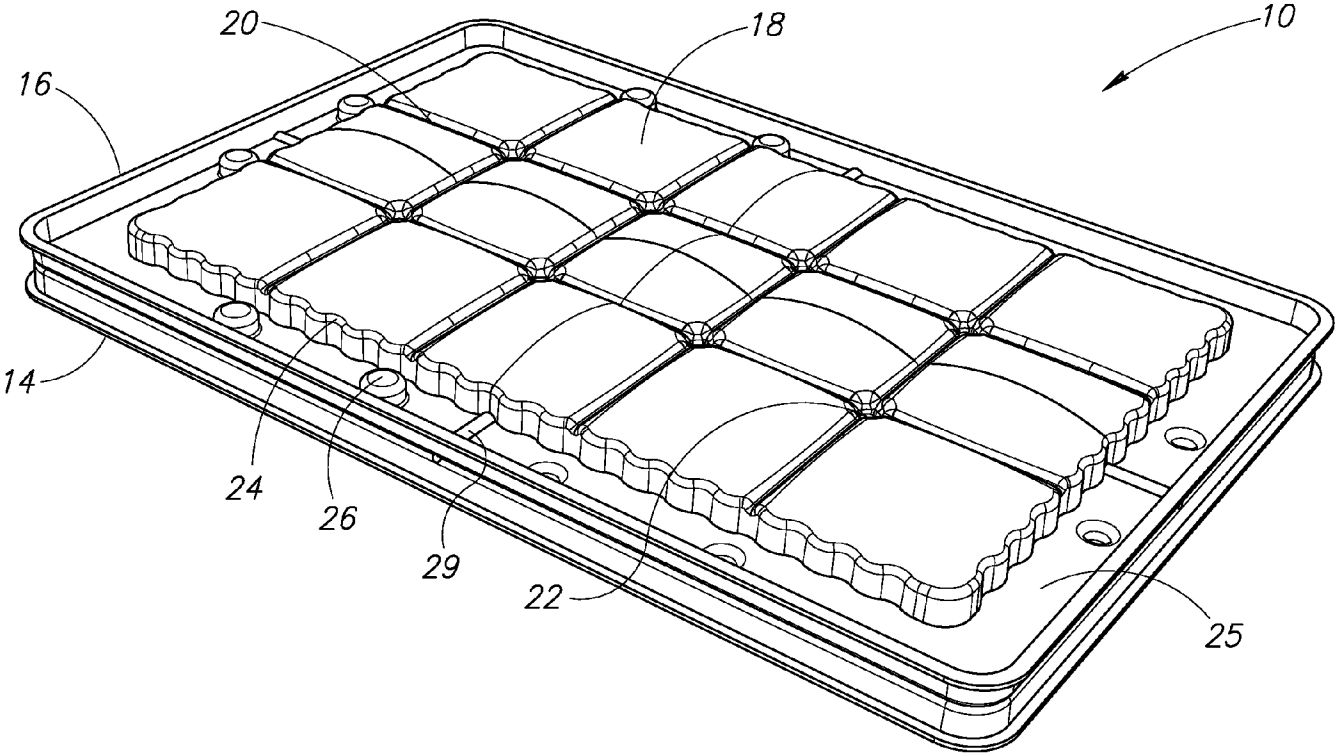
FIG. 1 is a schematic illustration of a novel food vacuum container, constructed and operative in accordance with an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Applicants have realized that cooked or baked foods, such as pizzas or pies, if placed directly into vacuum bags for the purpose of vacuum packaging, are condensed under the vacuum pressure and lose their shape and volume. The resultant food may appear unappetizing and may lose its texture and, as a result, cannot be used for display or for sale.

Figure 2:
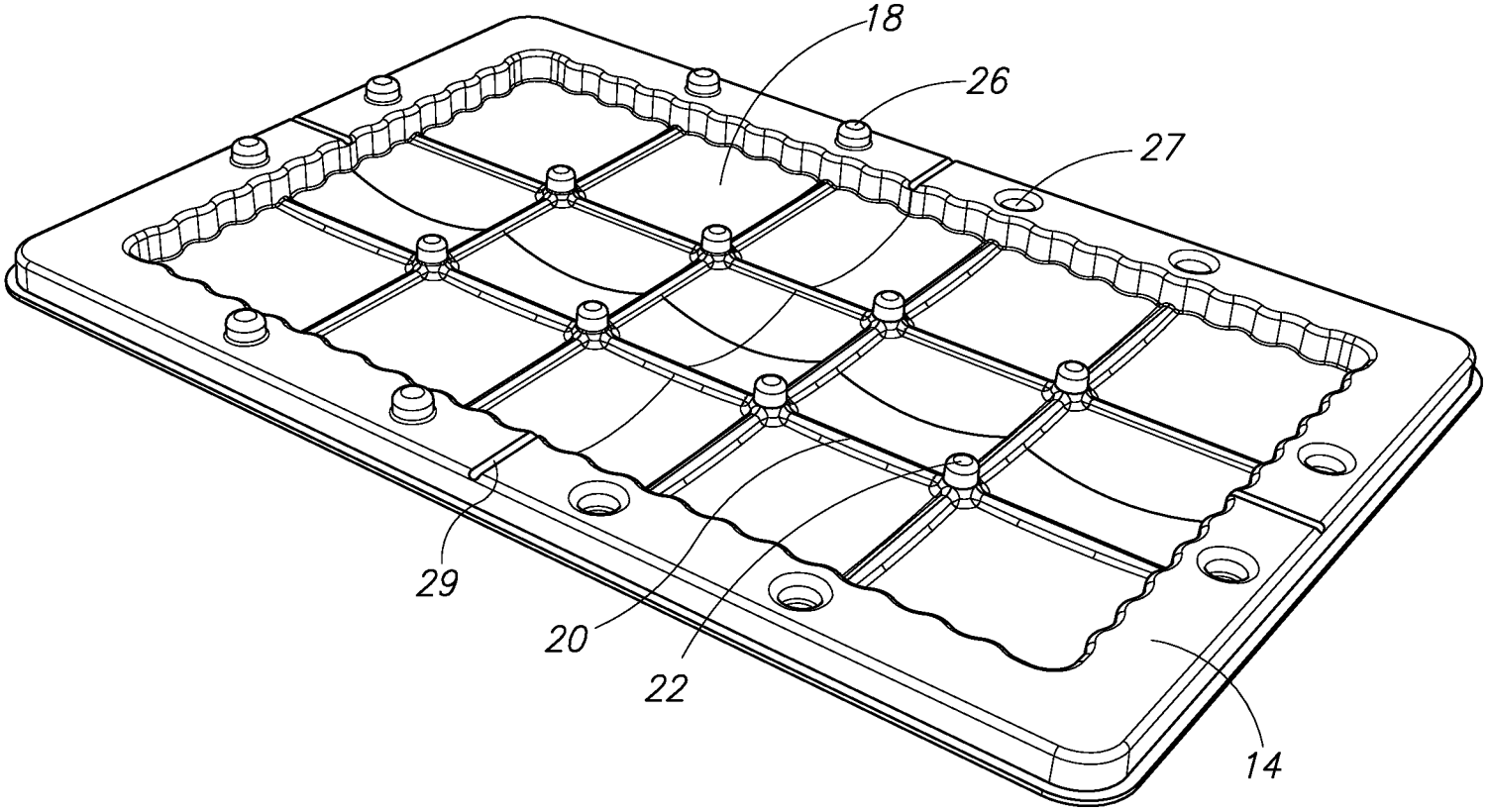
FIG. 2 is a schematic illustration of the container of FIG. 1 in which the container is open, in accordance with an embodiment of the present invention.
Figure 3:
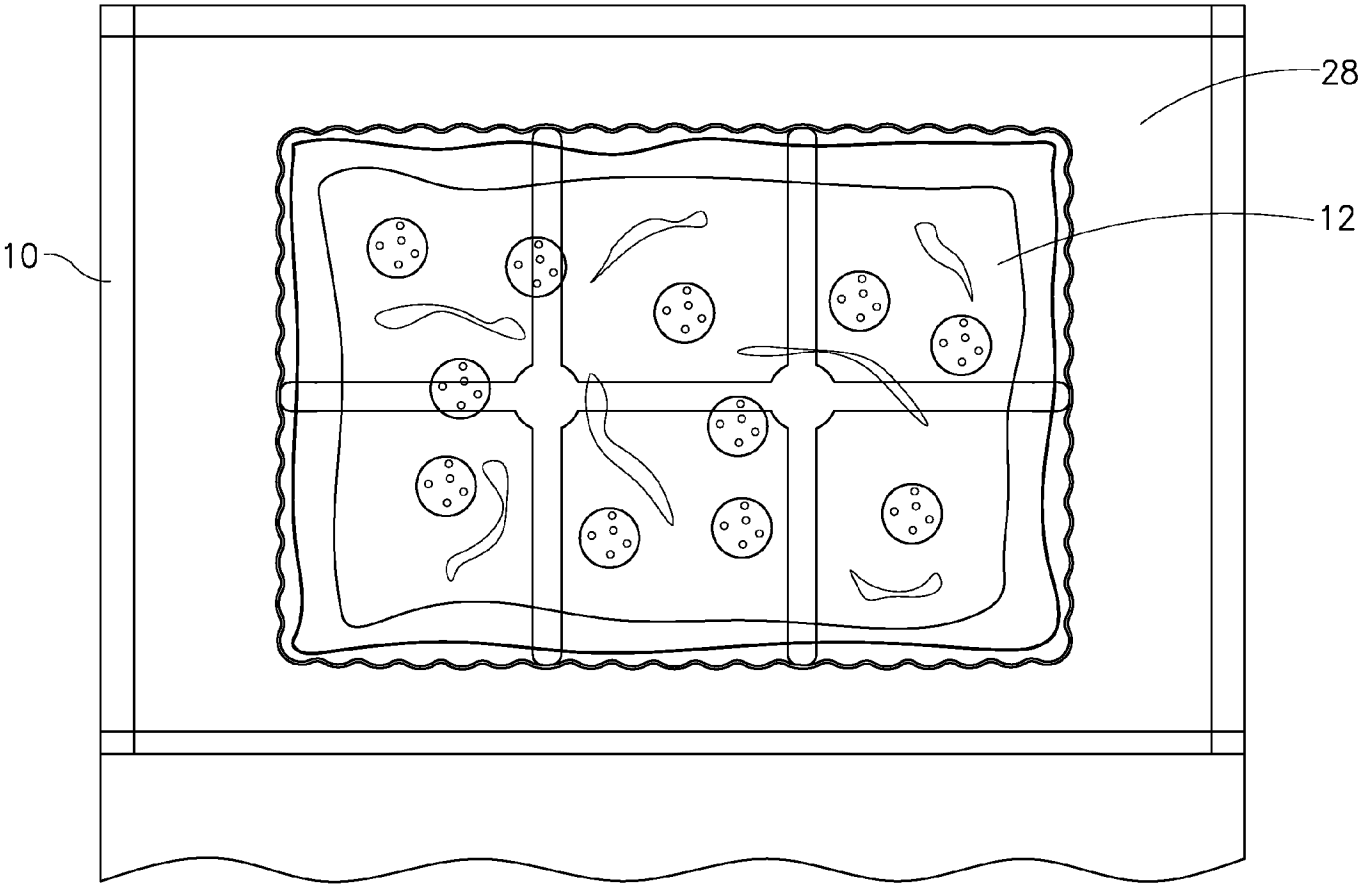
FIG. 3 is a schematic illustration of the food container of FIG. 1 including vacuum container of FIG. 1 containing food and sealed in a vacuum bag, in accordance with an embodiment of the present invention.
Figure 4:
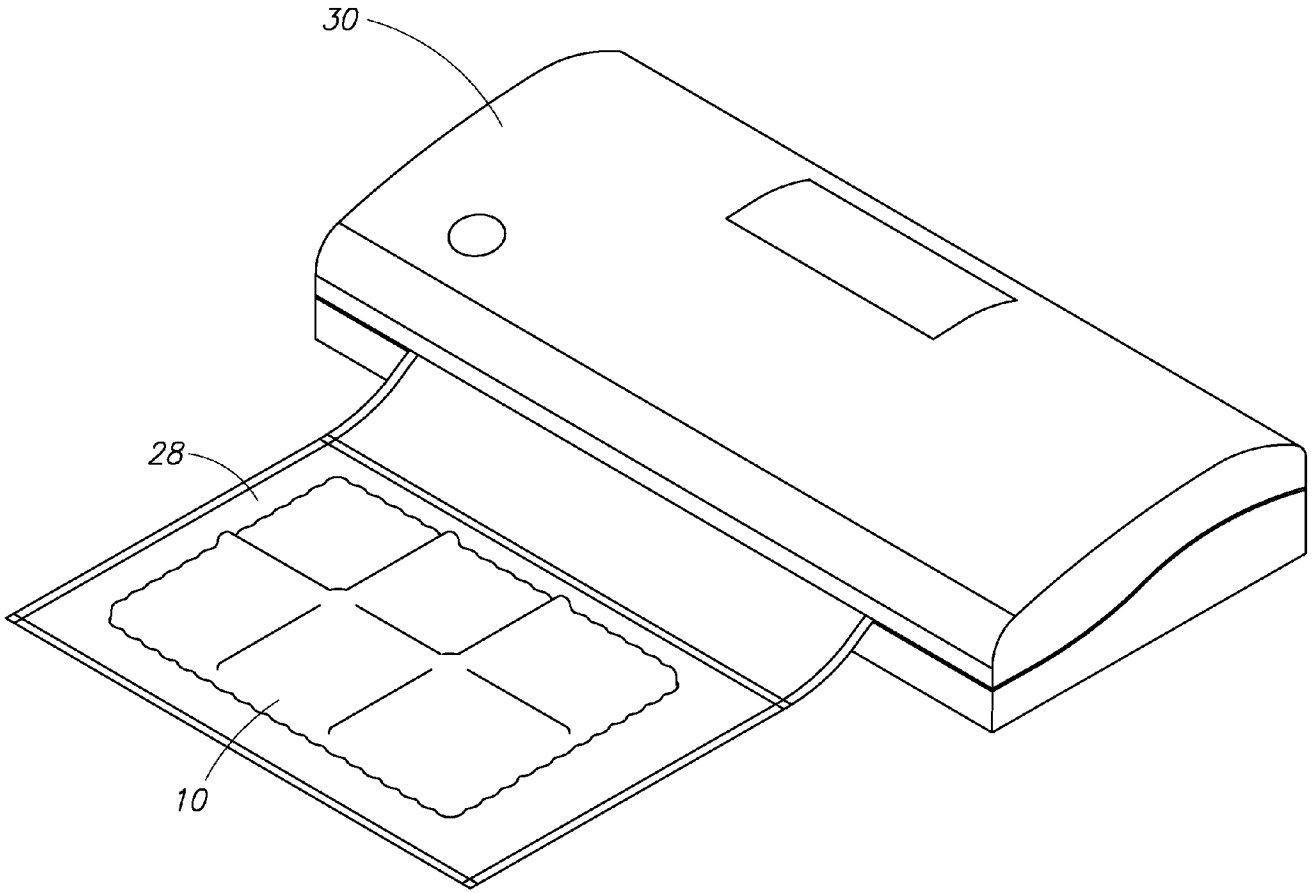
FIG. 4 is a schematic illustration of the vacuum container of FIG. 1 being sealed in a vacuum machine, in accordance with an embodiment of the present invention.

Reference is made to FIGS. 1, 2 and 3 which illustrate a novel food vacuum container 10 which maintains its shape and volume under vacuum seal conditions. FIG. 1 shows container 10 closed, FIG. 3 shows container 10 with food 12 inside, while FIG. 2 shows container 10 in an open state. Reference is further made to FIG. 4 which shows a vacuum sealing machine 30 connected to a vacuum bag 28 which may seal container 10.

In accordance with a preferred embodiment of the present invention, container 10 may store food 12 generally in a vacuum state with minimal deformation of the shape and volume of food 12. It will be appreciated that, because food 12 may be kept within a vacuum, it may be stored for a relatively long period of time and with no need to store the food in chilled or frozen conditions.

Container 10 comprises a bottom 14 and a corresponding lid 16, each of which comprises a plurality of convex load bearing units 18, canal shaped reinforcement ribs 20, circular reinforcement units 22 and scalloped edges 24. Convex load bearing units 18 may be supported by canal shaped reinforcement ribs 20, such that there is one circular reinforcement unit 22 at every rib crossing. Convex load bearing units 18 may bear external atmospheric air pressure against the internal vacuum and therefore food may be kept in container 10 without being condensed or smashed despite the internal vacuum conditions. Scalloped edges 24 may further strengthen load bearing units 18.

It will be appreciated that reinforcement unit 22 may be formed in various shapes and sizes such as horizontal support bars.

In a preferred embodiment of the present invention, bottom 14 and lid 16 may be see-through, so that people may clearly see food 12 that is inside container 10.

In another preferred embodiment of the present invention, container 10 may comprise rims 25 which have holes 27 and matching pins 26, such that bottom 14 and lid 16 may be closed and aligned when matching pins 26 go into holes 27. Rims 25 may include air conduits 29 which lead to the interior of container 10 and facilitate air removal from the interior when vacuum sealing.

As illustrated in FIG. 1, in a first preferred embodiment of the present invention, bottom 14 and lid 16 may each comprise fifteen convex load bearing units 18 supported by six canal shaped reinforcement ribs 20 with circular reinforcement units 22 at every rib crossing and scalloped edges 24 around the perimeter. Reinforcement ribs 20 may be convex or concave. It may be appreciated that reinforcement ribs 20 may include a solid cross-section, a hollow cross-section, and/or may include other shapes, such as for example, an L-shape, a T-shape, among other possible structural shapes. In some embodiments, reinforcement ribs 20 may be embedded in convex load bearing units 18 and may include a material strength greater than that of the convex load bearing units, and may withstand a pressure loading of up 2 $kg/cm^2$, for example, for example 0.5 $kg/cm^2$, 1 $kg/cm^2$, 1.5 $kg/cm^2$.

It will be appreciated that container 10 may be implemented as two separated units or connected as a single unit which may be folded over in order to be closed.

As illustrated in FIG. 3, food 12, such as a slice of pizza, may be placed into container 10, which may then be placed into a standard vacuum bag 28, such as a polyethylene bag available from Orved Corporation. Vacuum bag 28 and container 10 may be placed into a vacuum machine, as illustrated in FIG. 4, such as a vacuum sealing machine, an automatic vacuum chamber machine or a continuous vacuum machine, which may remove the air from vacuum bag 28 and may seal it, thereby removing the air from container 10. A suitable vacuum machine may be any of those commercially available from Wenzhou Packing Machinery Co. Ltd. It will be appreciated that, in accordance with a preferred embodiment of the present invention, container 10 may enable food 12 to maintain its shape, volume and position despite the vacuum seal conditions for a relatively long period of time and with no need to store the food in chilled or frozen conditions.

It will be appreciated that food 12 in container 10 may be hung for display or shipped without moving within the container, due to the fact that container 10 may be designed three dimensionally in very similar measurements to food 12 it comprises and due to the circular reinforcement units 22, which may penetrate throughout food 12 and keep it still.

It will be appreciated that, while the external pressure may be atmospheric, the internal pressure is at or is close to a vacuum so that load bearing units 18 and reinforcement ribs 20 may support a pressure differential of up to 2 $kg/cm^2$, for example 0.5 $kg/cm^2$, 1 $kg/cm^2$, 1.5 $kg/cm^2$. For example, and as shown in FIG. 1 to which reference is now briefly made, each unit 18 may be 4 cm×4 cm, each canal shaped reinforcement rib 20 may be 6 mm, with a curved upper or lower surface having a radius of curvature of 53.72 mm, and being formed of a transparent plastic such as, Polypropylene, Polystyrene, Polyethylene or Acrylonitrile Butadiene Styrene (ABS) of 1.2 mm thickness. Other shapes, sizes and thicknesses may be possible and may be incorporated herein in the present invention.

Container 10 may be formed of a disposable plastic or other inexpensive disposable material making the container relatively inexpensive and allows its use as a disposable container.

Figure 5:
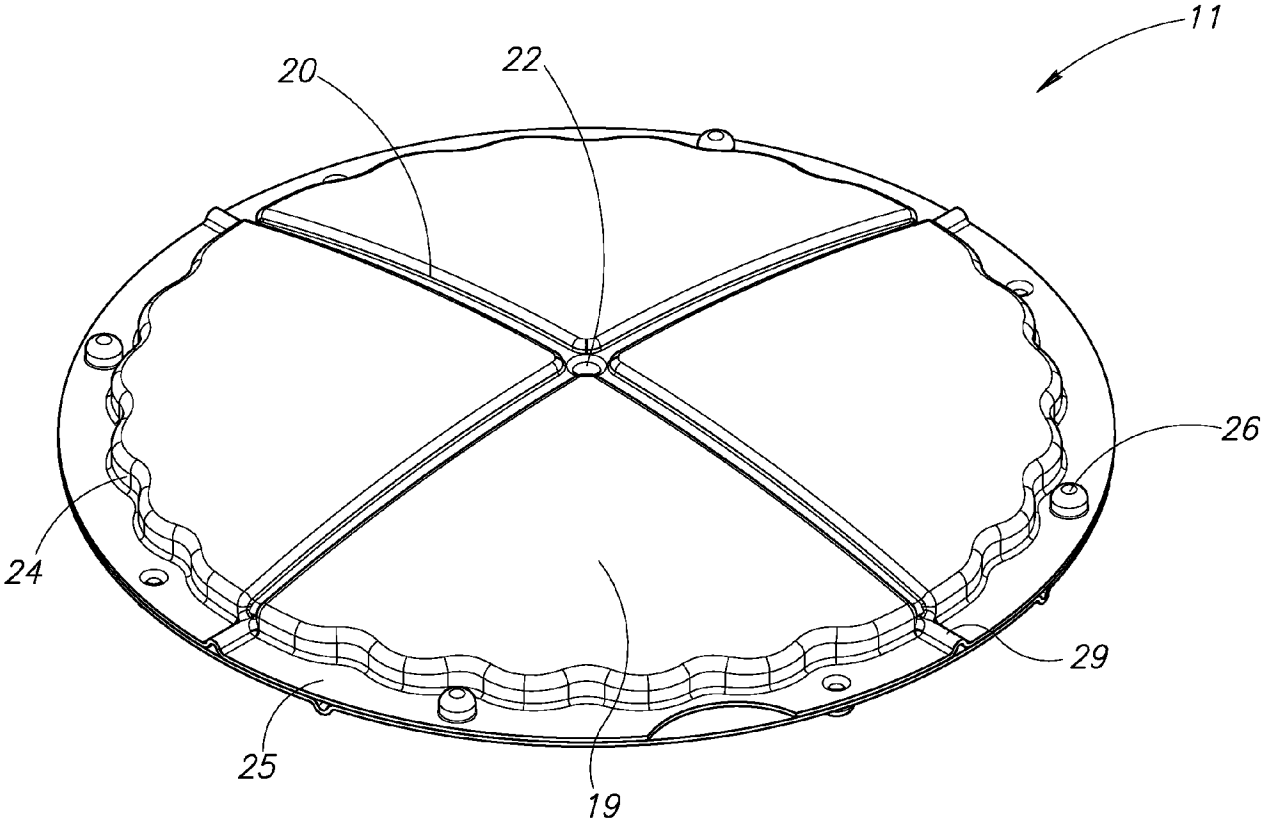
FIGS. 5, 6 and 7 are schematic illustrations of alternative embodiments of the novel food vacuum container of FIG. 1, constructed and operative in accordance with alternative embodiments of the present invention.

Reference is now made to FIG. 5, which illustrates another preferred embodiment of the present invention. FIG. 5 shows a round container 11, comprising four pie slice shaped, convex load bearing units 19, which may be supported by two canal shaped reinforcement ribs 20 with a circular reinforcement unit 22 at the rib crossing. As in the previous embodiment, container 11 may comprise scalloped edges 24. Other round containers may have different number of convex load bearing units 19 and thus different number of canal shaped reinforcement ribs 20 and circular reinforcement units 22. Container 11 may include a rim 25 with air conduits 29 which lead to the interior of the container and facilitate air removal from the interior when vacuum sealing.

Figure 6:
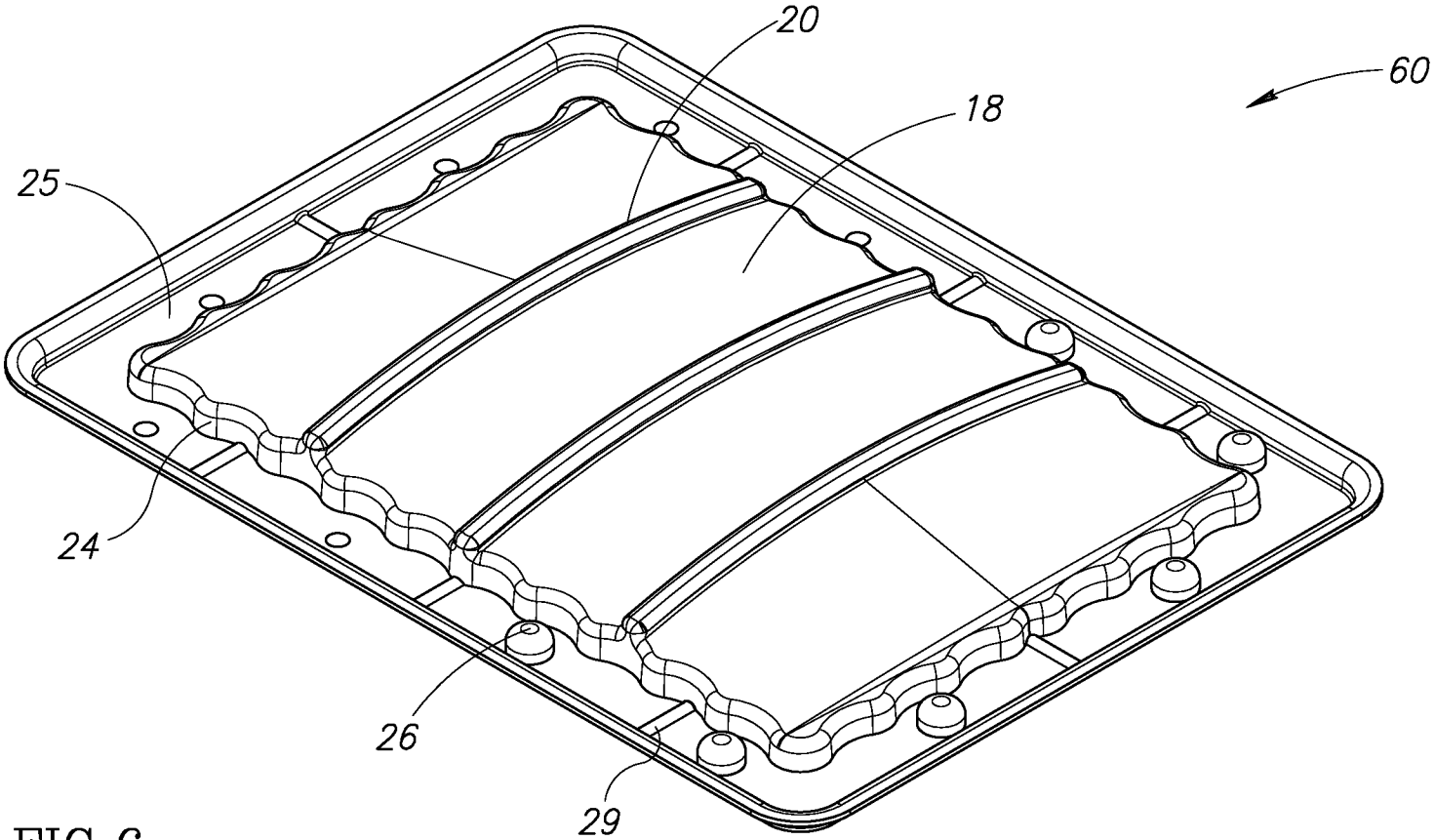

Reference is now made to FIG. 6, which illustrates another preferred embodiment of the present invention. FIG. 6 shows a container 60 comprising convex load bearing units 18 with no circular reinforcement units 22 as in container 10. Reinforcement ribs 20 may be thicker in order to strengthen the load bearing units. Reinforcement ribs 20 may be convex or concave. As in the previous embodiments, container 60 may comprise scalloped edges 24. Container 60 may include a rim 25 with air conduits 29 which lead to the interior of the container and facilitate air removal from the interior when vacuum sealing.

Figure 7:
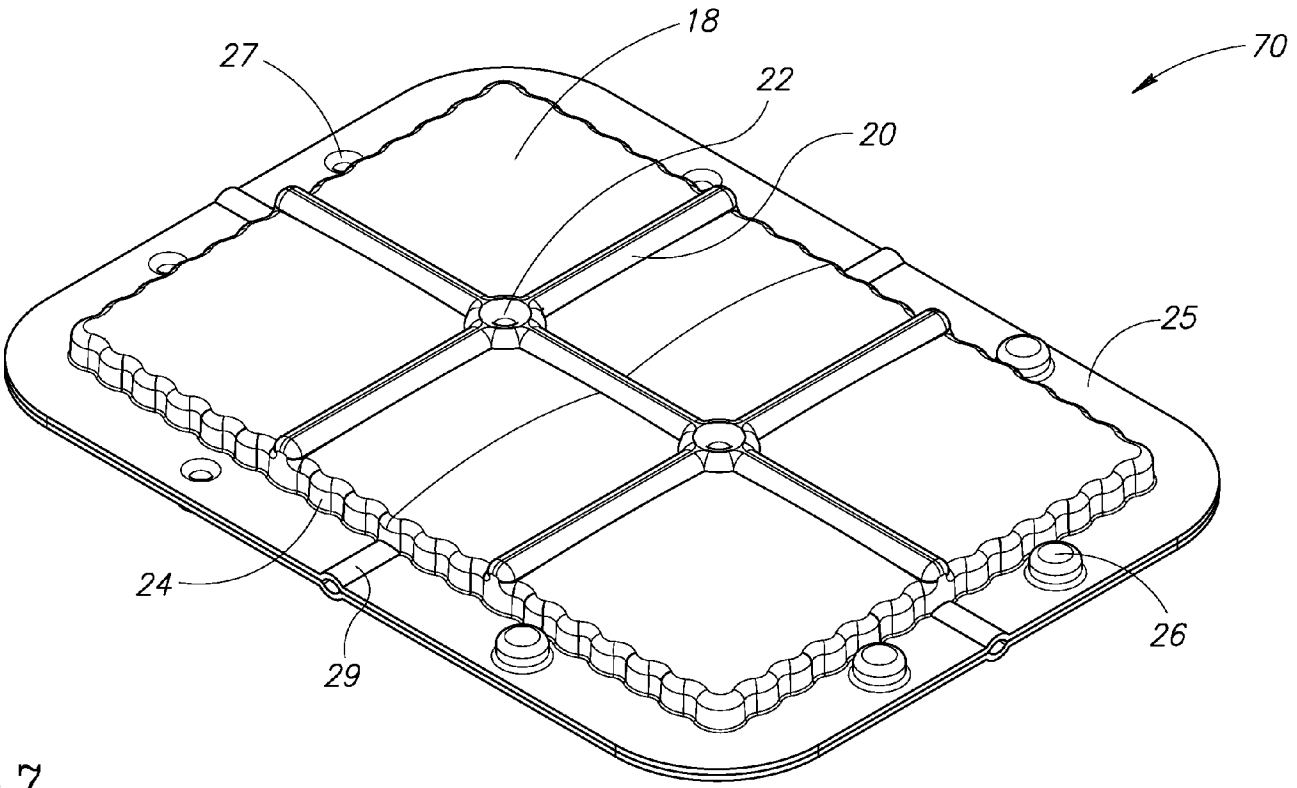

Reference is now made to FIG. 7, which illustrates a preferred embodiment of the present invention in which a container 70 comprises six convex load bearing units 18 supported by three canal shaped reinforcement ribs 20 with a circular reinforcement unit 22 at each of the two rib crossing, as well as having scalloped edges. Container 70 may include a rim 25 with air conduits 29 which lead to the interior of the container and facilitate air removal from the interior when vacuum sealing. In this embodiment, container 70 may be 12 cm long and 8 cm wide.

Figure 8:
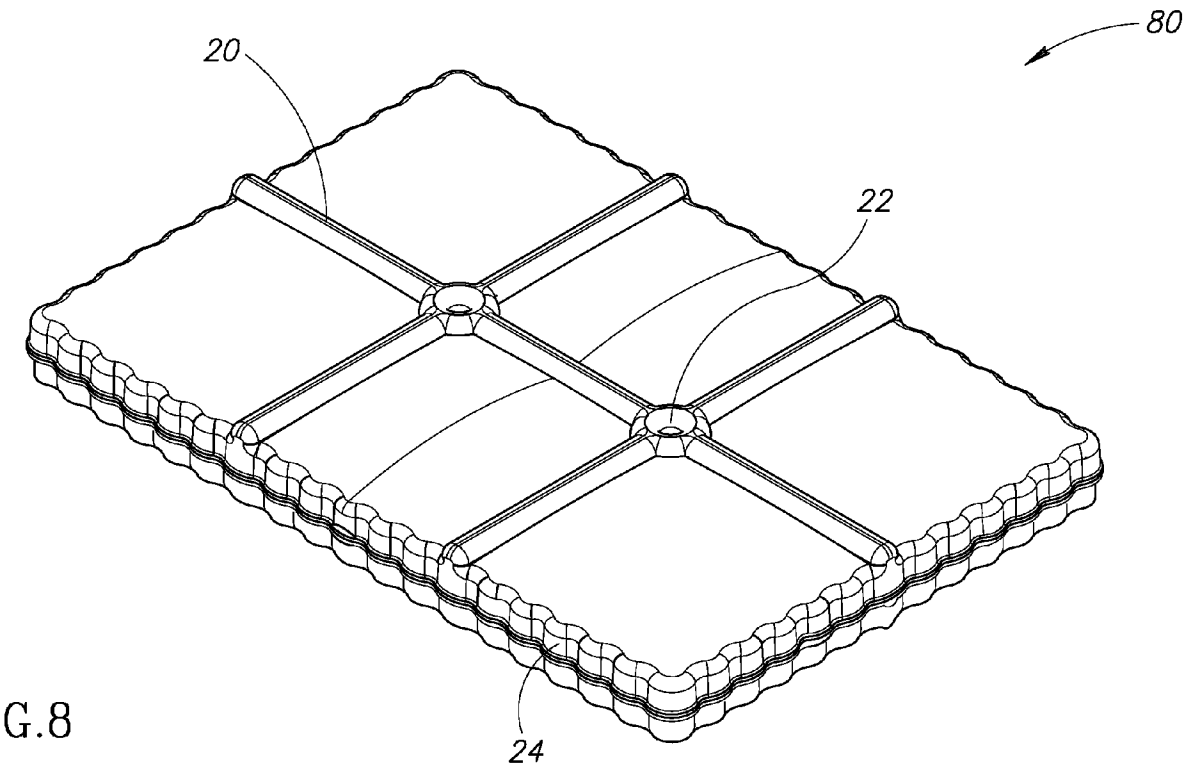
FIG. 8 is a schematic illustration of a novel food vacuum container according to another embodiment of the present invention, in which the container does not have rims.

Reference is now made to FIG. 8, which illustrates a preferred embodiment of the present invention in which a container 80 does not have rims 25 as in container 10.

Figure 9:
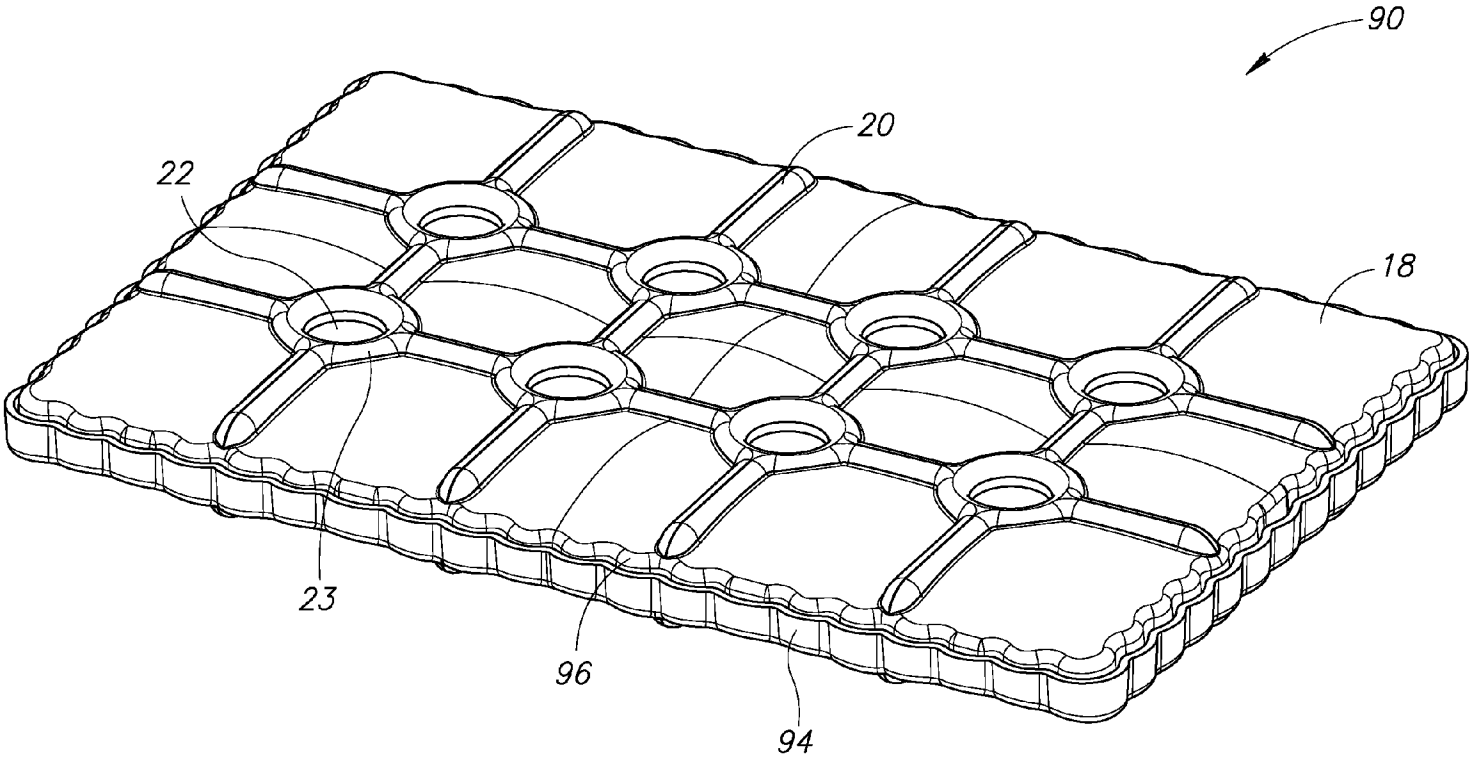
FIG. 9 is a schematic illustration of a rim-less novel food vacuum container according to another embodiment of the present invention.
Figure 10:
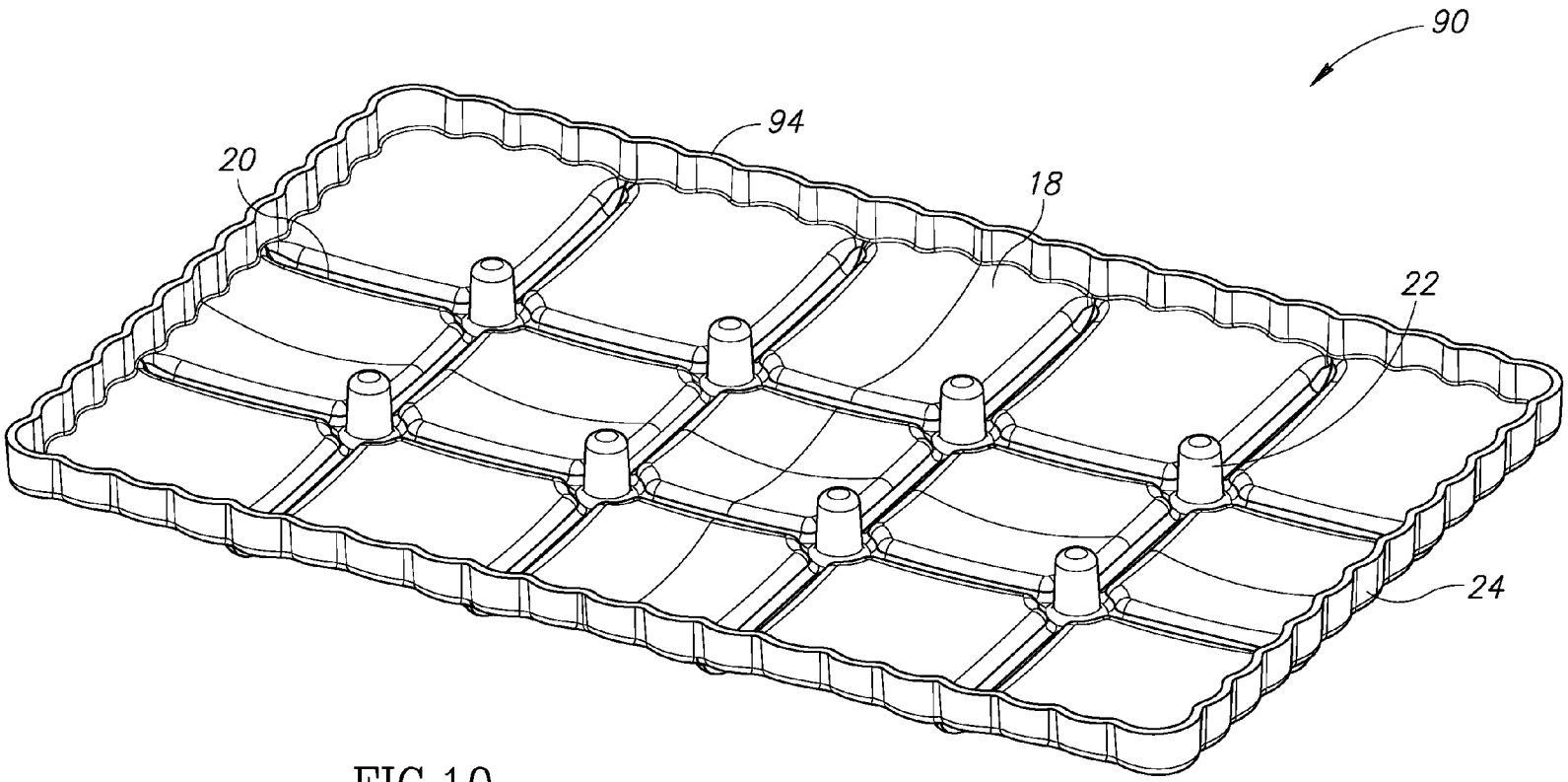
FIG. 10 is a schematic illustration of a bottom tray of the vacuum container of FIG. 9, in accordance with an embodiment of the present invention.
Figure 11:
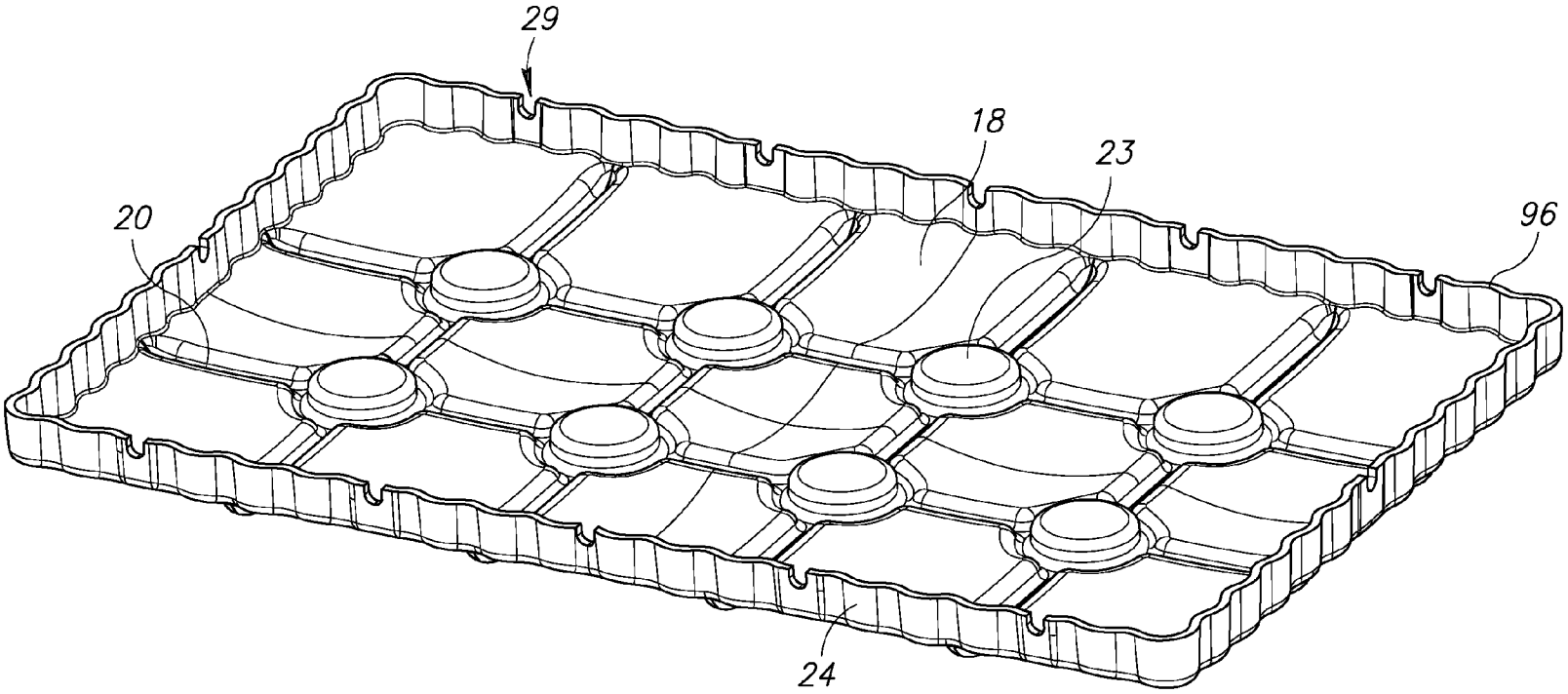
FIG. 11 is a schematic illustration of a lid of the vacuum container of FIG. 9, in accordance with an embodiment of the present invention.

Reference is now made to FIGS. 9-11, which schematically illustrate a rim-less food vacuum container 90 with 15 load bearing units 18, in accordance with an embodiment of the present invention. Container 90 includes a bottom tray section 94 (FIG. 10) and a cover (lid) 96 which correspondingly fits onto the bottom section. Load bearing units 18 are supported by canal shaped ribs 20, a total of eighteen used to support the 15 load bearing units. Circular reinforcement units 23 are located at every rib crossing and may serve both to reinforce the ribs and the load bearing units 18. Circular reinforcement units 23 may include pins 22 which may penetrate into the food to prevent movement. Both bottom tray 94 and cover 96 include scalloped shaped edges 24 which may serve to further reinforce load bearing units 18. Notches 29 on cover 96 may allow air to be more easily drawn out from inside container 90 during vacuum sealing of the container. Additionally or alternatively, notches 29 may be included in bottom tray 94.

It will be appreciated that the strength of containers 10-90 may be created by a combination of two or more elements such as the thickness of the containers, the thickness of rims 25, the width and number of reinforcement ribs 20, the curve of load bearing units 18, the size of circular reinforcement units 22, the size of scalloped edges 24 and the amount of vacuum in the containers.

In a preferred embodiment the thickness of the containers is between 0.5 mm to 2.5 mm.

In another preferred embodiment, the amount of vacuum in the containers is above 90%.

Applicants have realized that for thinner food items such as pizza, quiche and crepes, a flatter container is more desirable in order to preserve shape rather than the higher walled or higher domed container as discussed herein above. Unless the food is held in position by pins 26, a flat piece of food may move around the container and may become misshapen. It will be appreciated that for stackable food items (such as a pile of pizzas or crepes), a high wall or a high domes container may be more suitable.

It will be appreciated that the design of a flatter thinner container is more challenging in terms of mechanical strength. It is known in the art that a container with a higher wall or a dome shape will resist vacuum pressure more easily than a lower wall with a matching flat wide area top or lid. Applicants have realized that this challenge may be overcome when using a lower walled container, by using specially designed maximum strength area elements with proper reinforcements.

Figure 12:
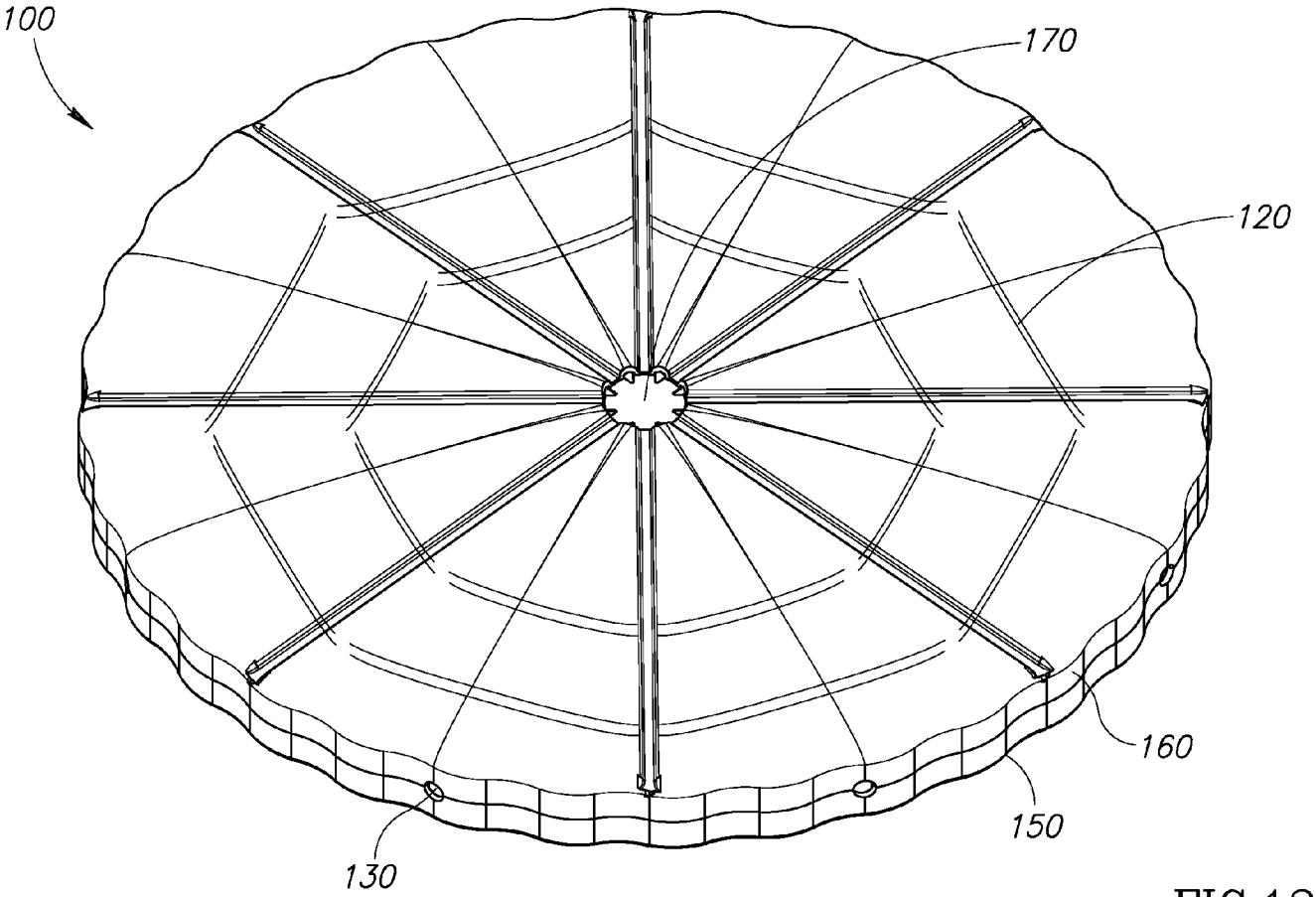
FIG. 12 is a schematic illustration of an alternative embodiment to the container of FIG. 1, constructed and operative in accordance with an embodiment of the present invention.

Reference is now made to FIG. 12 which illustrates an alternative container 100 in accordance with an embodiment of the present invention. Container 100 may be round in shape with approximately a 24 cm diameter, a surface area of approximately 452 $cm^2$ and a wall height of approximately 2-3 cm. It will be appreciated that although the following discussion is for a round container, the principles may be applied to other shaped containers which may be designed accordingly to the shape of the food items to be stored.

Figure 13:
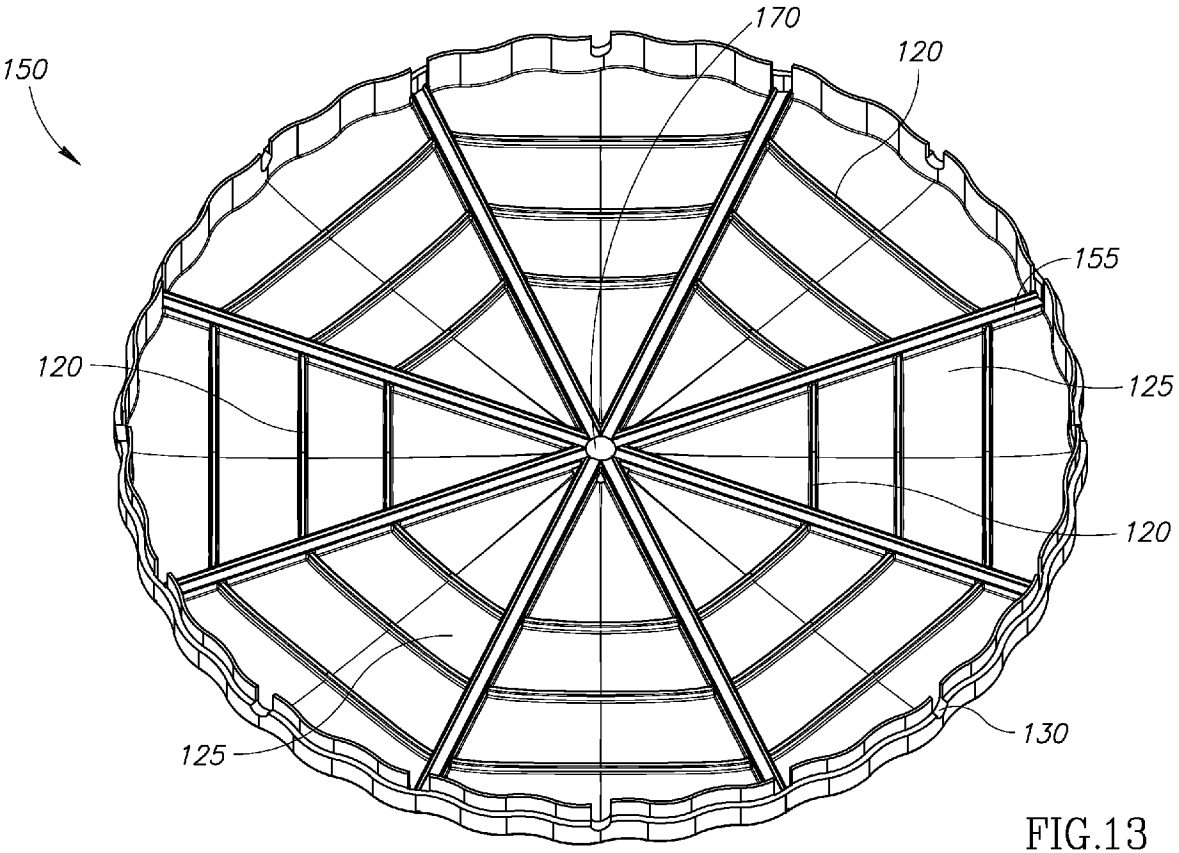
FIG. 13 is a schematic illustration of the base of the container of FIG. 12, constructed and operative in accordance with an embodiment of the present invention.
Figure 14:
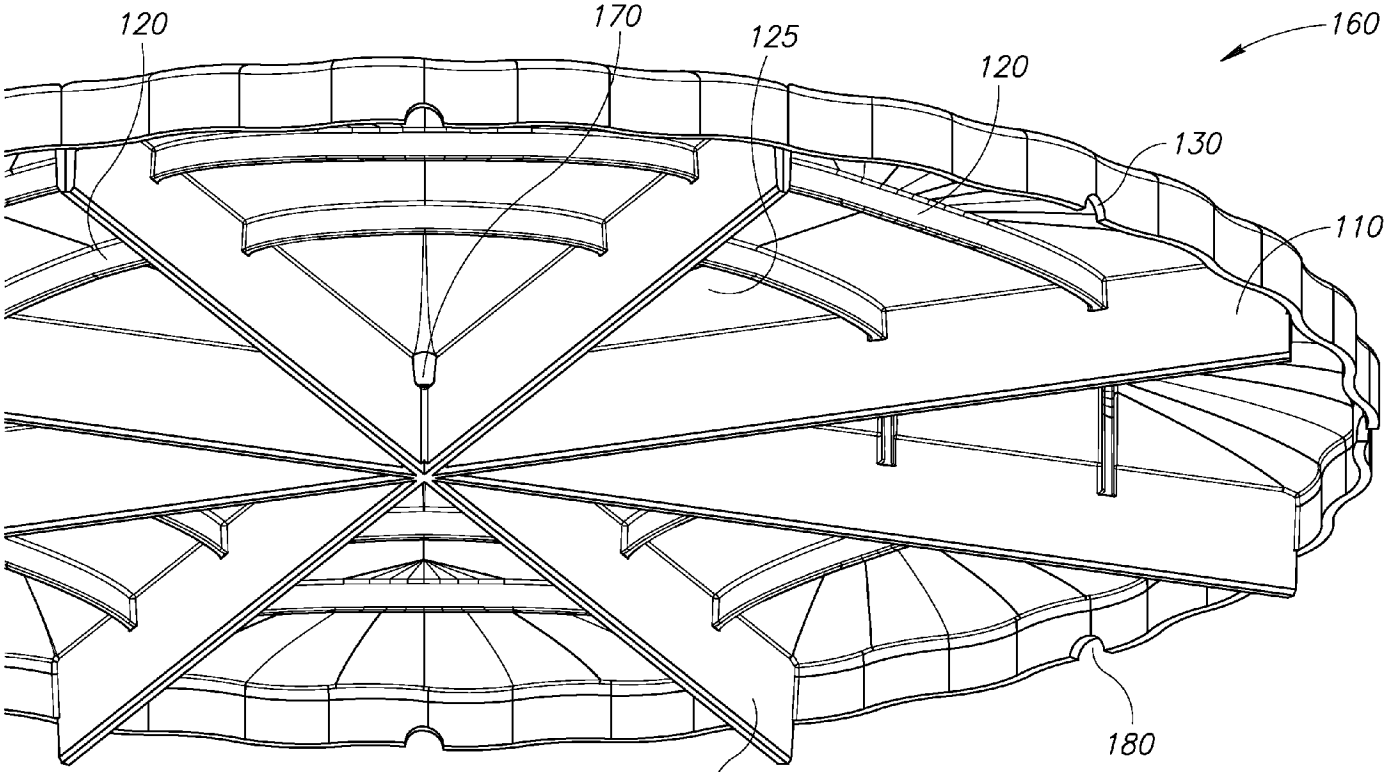
FIG. 14 is a schematic illustration of the lid of the container of FIG. 12, constructed and operative in accordance with an embodiment of the present invention.

Container 100 may further comprise a base 150 and a lid 160 as is illustrated in FIGS. 13 and 14 to which reference is now made. FIG. 13 illustrates base 150 and FIG. 14 illustrates lid 160.

Base 150 may comprise runners 155 which may divide the entire surface area of base 150 into equally sized triangular portions 125 of approximately 56.5 $cm^2$. Each runner 115 may be connected to a secondary runner 115 via several reinforcement ribs 120 which may be perpendicular to runners 115. Likewise, lid 160 may comprise blades 165 which may divide the entire surface area of lid 160 into the same equally sized triangular portions 125. Each blade 110 may also be connected to a secondary blade 110 via several reinforcement ribs 120 which may perpendicular to blades 110. When lid 160 is placed over base 150, blades 165 may slot into runners 115. In an alternative embodiment, base 150 may comprise a single central runner and lid 160 may comprise a single central blade which may divide the surface areas into 2 equally sized portions.

It will be further appreciated that container 100 may also comprise circular reinforcement units 22 and scalloped edges 24 as discussed herein above and each triangular portion 125 may further comprise multiple load bearing units 118. In the example of FIG. 13, each triangular portion 125 is shown to comprise 4 load bearing units 118. Load bearing units 118 may be arch shaped with a slight curve.

Figure 15:
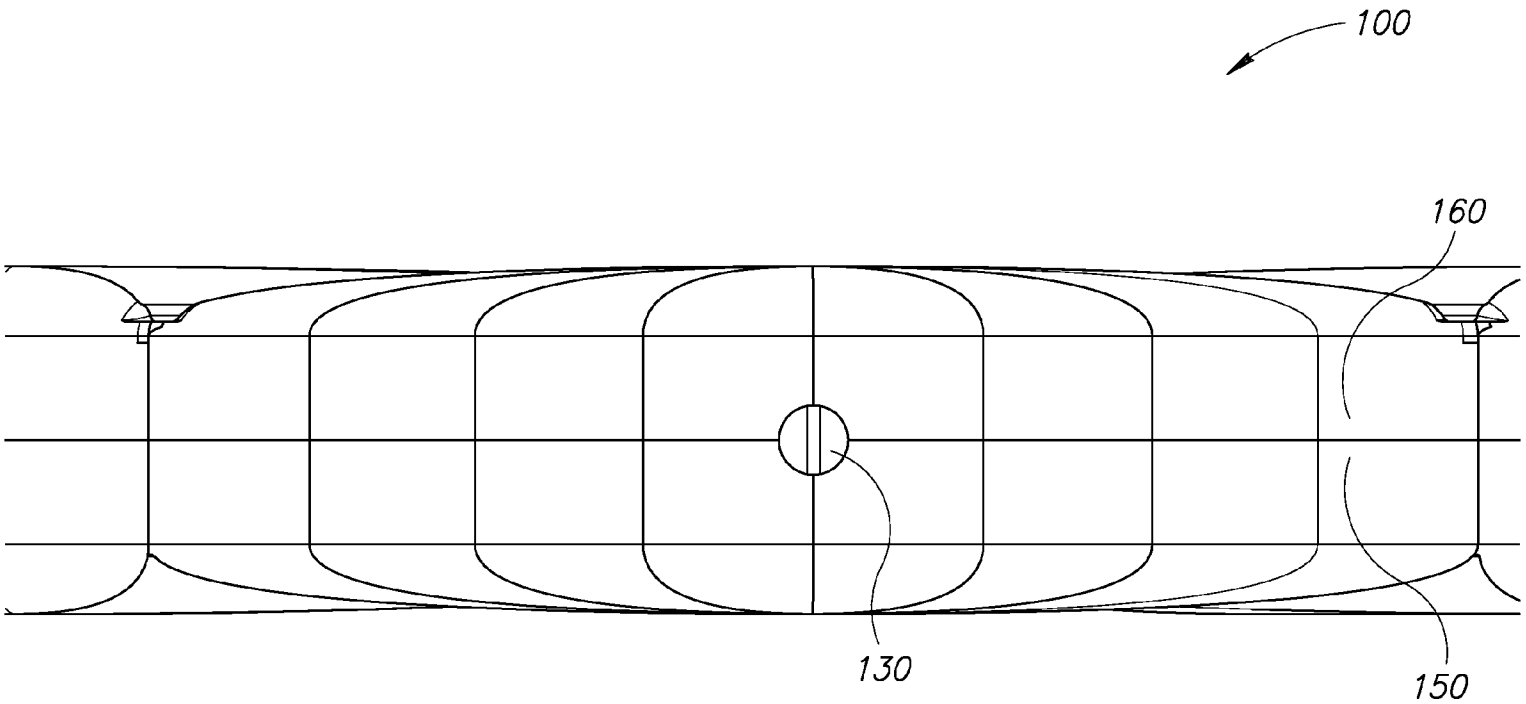
FIG. 15 is a schematic illustration of an alternative view of the container of FIG. 12; constructed and operative in accordance with an embodiment of the present invention.

Both base 150 and lid 160 may also comprise semicircular holes 180 evenly placed around their perimeters. When lid 160 is attached to base 150, these holes may form air inlets 130 to extract air from container 100 before a vacuum is created as discussed herein above and as is represented in FIG. 15 to which reference is now made. Both base 150 and lid 160 may also comprise air inlets 170 positioned at each center. It will be appreciated that inlets 130 and 170 may ensure that all the air is extracted from container 100 during the vacuuming process, without affecting the overall mechanical strength of the container. It will be further appreciated that when lid 160 is placed over base 150 and blades 110 and sitting within runners 114 and container 100 is effectively closed. The effect of the vacuum formed within container 100 may ensure that container 100 is airtight and sealed due to the atmospheric pressure build up.

As discussed herein above, while the external pressure may be atmospheric, the internal pressure may be or be close to a vacuum so that load bearing units 18 and reinforcement ribs 20 may support a pressure differential of up to 2 kg/cm$^2$, for example 0.5 kg/cm$^2$, 1 kg/cm$^2$, 1.5 kg/cm$^2$. Thus each unit 18 may be 4 cm×4 cm. These principles may be applied to container 100, load bearing units 118 and reinforcement ribs 120 (together with reinforcement units 22 and scalloped edges 24).

Thus the area of each load bearing unit 118 may be within the range of 14-19 cm$^2$. This may be considered approximately equivalent to the 4 cm×4 cm as discussed herein above—the known optimum strength area that resists deformation which may support a pressure differential of up to 2 kg/cm$^2$.

Therefore a container 100 divided into 8 triangular portions 125, may have a total surface area of 454.4 cm2 with each triangular portion 125 having a surface area of 56.55 cm$^2$. If triangular portion 125 is divided into 3 load bearing units 118, each load bearing unit may have a surface area 18.85 cm$^2$. If triangular portion 125 divided into 4 load bearing units 118, each load bearing unit may have a surface area 14.14 cm$^2$.

As discussed herein above, the strength of container 100 may be a combination of two or more elements such as the thickness of the containers, the thickness of rims 25, the width, curve and number of reinforcement ribs 120, the curve of load bearing units 118, the size of circular reinforcement units 22, and the size of scalloped edges Another factor that may be taken into account is the tolerance of the plastic used to manufacture container 100 and the thickness of the walls. It will be appreciated that the use of different plastic technologies to manufacture container 100 may allow for changing limits to the optimal dimensions for load bearing units 118 such to a greater surface area such as 25 cm$^2$.

It will be further appreciated that blades 110 may not only provide reinforced support against vacuum pressure, they may also penetrate the food that is placed in base 150. This penetration may be 2-fold, it may divide the food in question into equally sized portions and it may serve to hold the food in place within container 100 in a similar manner to pins 26 as described herein above.

Thus a piece of food such as a slice of pizza may be placed on base 150 over runners 115. When lid 160 is placed over base 150, in order to close container 100, blades 110 may penetrate the pizza until they slot into runners 115. It will be appreciated that according to the sharpness of blades 110, blades 110 may easily cut through the pizza when sharp edged or may trap part of the pizza between blades 110 and runners 115 if particularly blunt. Blades 110 may be plain edge and manufactured from any form of plastic such as polypropylene, polyethylene, polystyrene and ABS and may be food compatible and environmentally friendly. For a typical flatter container of height of approximately 2-3 cm as described herein above, blades 110 may be 2-3 cm long.

In an alternative embodiment, blades 110 may be used with a higher walled or domed container in which flatter foods (such as pizza, crepes etc. as described herein above) may be stacked. In this scenario, blades 110 may have a longer length in order to cut through and/or hold in place the stacked food as described herein above. It will be appreciated that for a stack of 5 pizzas, blades 110 may typically be 10 cm long.

Figure 16:
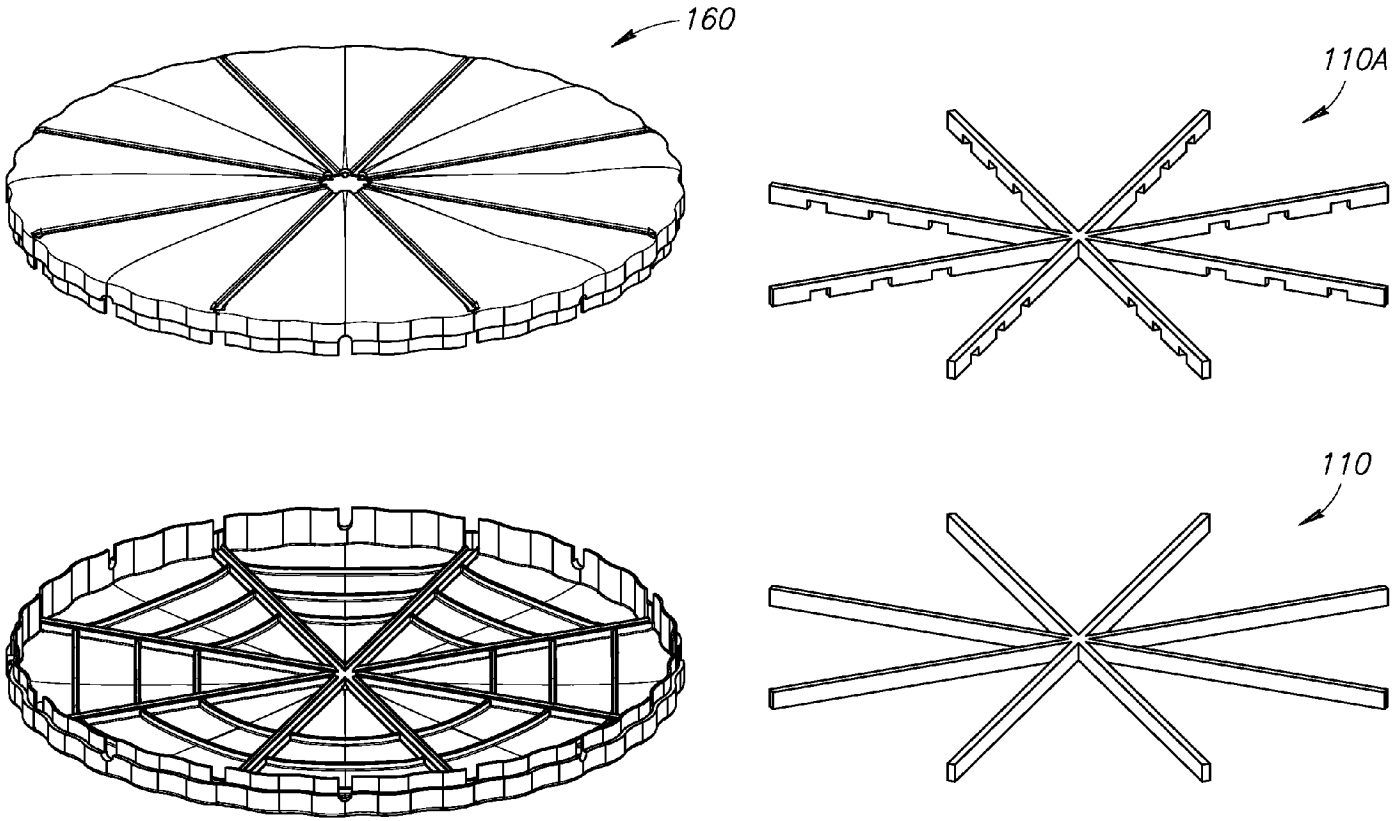
FIG. 16 is a schematic illustration of the blades of container of FIG. 12, constructed and operative in accordance with an embodiment of the present invention.

It will also be appreciated that blades 110 may be a unitary body and molded with lid 160. In an alternative embodiment, blades 110 may be detachable from lid 160 after use as is illustrated in FIG. 16 to which reference is now made. FIG. 16 illustrates how blades 110 and serrated blades 110A are removable from lid 160. It will be appreciated that blades 100 may also be removed for easy washing or rinsing and then returned once they are clean.

It will also be appreciated that the use of detachable blades 110 may also reduce the complexity and/or costs of manufacturing container 100 since lid 160 may be manufactured using vacuum forming instead of injection molding. It will be appreciated that injection molding is a desired manufacturing method if blades 110 are molded to lid 160.

It will be further appreciated that surface area of a cut slice of pizza may be identical to that of triangular area 125 and may fit the area exactly thus staying in place when the container is handled.

Once container 100 is closed, it may be sealed using vacuum sealing machine 30 and vacuum bag 28 as described herein above. It will be appreciated that once vacuum sealed, the pizza in container 100 may be stored at an ambient temperature for approximately 2 months while maintaining its quality. It will be further appreciated that the pizza may keep its quality for approximately another 2 months if container 100 is placed in refrigeration.

Figure 17A:
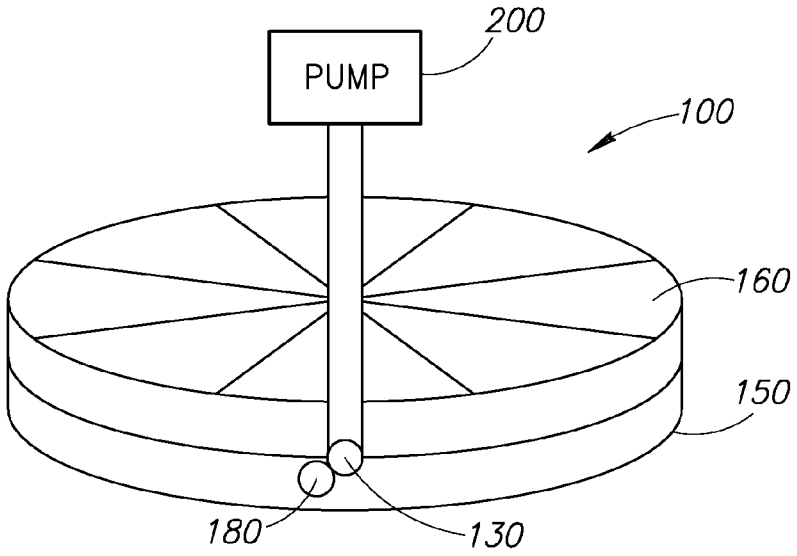
FIGS. 17A and 17B are schematic illustrations of an alternative method of air extraction for the containers of FIGS. 1 and 12, constructed and operative in accordance with an embodiment of the present invention.
Figure 17B:
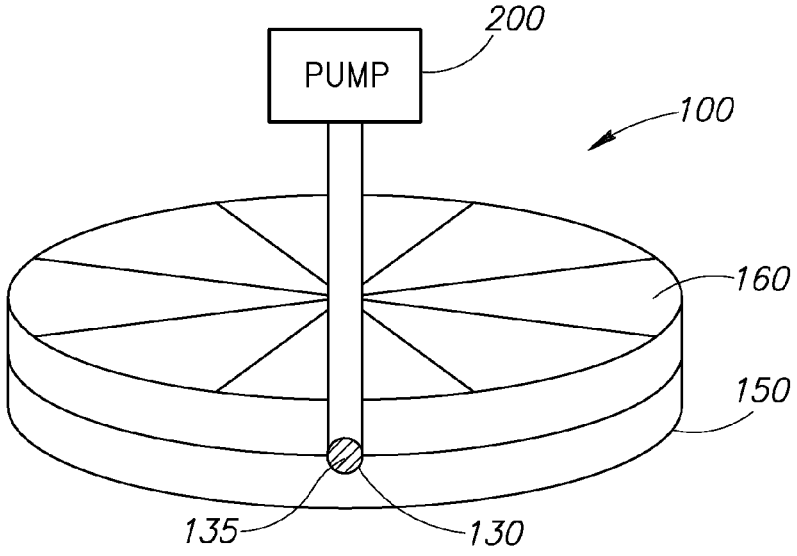

In accordance with an alternative embodiment of the present invention, both containers 10 and 100 may be "self-sealing" and may be sealed without vacuum sealing machine 30 and vacuum bag 28. In this embodiment, both containers 10 and 100 when closed may comprise a single conduit 29 (container 10), or a single inlet 130 or 170 (container 100) as is illustrated in FIGS. 17A and 17B to which reference is now made. FIGS. 17A and 17B represent container 100 with a single inlet 130 as a self-sealing container but the principles may also be applied to the use of inlet 170 and container 10. It will be appreciated inlet 130 may be connected accordingly to any simple industrial vacuum pump 200, which, when activated by a user, may withdraw air from containers 10 and 100 as described herein above.

It will be further appreciated that the surface of inlet 130 may be likened to a membrane or one directional diaphragm 135 which may allow for air to pass through it and which may also be sealable using ultrasonic welding or glue as known in the art. Alternatively, containers 10 and 100 may also comprise an attached (or attachable) cap 180 in order to seal inlet 130 once the air has been removed.

Thus not only may a container store fresh and cooked food within a vacuum environment, it may also hold flatter foods, evenly and cleanly slice them without the need for further utensils and may ensure that it is held in place and does not become misshapen when the container is moved.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A vacuum sealable container for baked or cooked food, said container comprising:

a base section to receive said food in its entirety, said base section having at least one runner wherein said at least one runner divides said base section into equally sized portions, wherein each said portion comprises a load bearing unit comprising a slightly outwardly curved, horizontally extended bottom surface supported by a scalloped edge and at least one reinforcement rib, wherein a height of said scalloped edge is significantly smaller than a diameter of said base section;

a lid shaped to fit over said base section, said lid having at least one blade wherein said at least one blade slots into said at least one runner when said lid is placed over said base to close said container and wherein said at least one blade is able to cut said food into said equally sized portions; and wherein said container is at least one of: sealed with a vacuum when used with a vacuum sealing bag and a vacuum machine and self-sealing; and wherein at least one of: said at least one blade, said at least one runner and said load bearing units provide reinforced support against deformation from a pressure differential of up to 2 $kg/cm^2$.

2. The container according to claim 1 and also comprising at least one air hole when said container is closed, wherein said vacuum machine withdraws air via said least one air hole to form said vacuum.

3. The container according to claim 1 and also comprising at least two reinforcement ribs placed perpendicularly to said at least one runner and said at least one blade.

4. The container according to claim 1 wherein said vacuum seals said lid against said base.

5. The container according to claim 1 and wherein said blades are at least one of: plain edge and serrated.

6. The container according to claim 1 and wherein said blades are manufactured from at least one of: polypropylene, polyethylene, polystyrene and ABS.

7. The container according to claim 1 and wherein said blades are at least one of: permanent and detachable.

8. The container according to claim 1 and wherein said food is at least one of: single and flat and multiple and stacked.

* * * * *